US008826783B2

(12) United States Patent
Hu

(10) Patent No.: US 8,826,783 B2
(45) Date of Patent: Sep. 9, 2014

(54) ONE-WAY OPEN-END WRENCH

(76) Inventor: Jia-Cheng Hu, Taichung (TW)

( * ) Notice: Subject to any disclaimer, the term of this patent is extended or adjusted under 35 U.S.C. 154(b) by 204 days.

(21) Appl. No.: 13/490,308

(22) Filed: Jun. 6, 2012

(65) Prior Publication Data

US 2013/0327187 A1 Dec. 12, 2013

(51) Int. Cl.
*B25B 13/08* (2006.01)
*B25B 13/46* (2006.01)

(52) U.S. Cl.
USPC ..... 81/179; 81/186

(58) Field of Classification Search
USPC ..... 81/179, 186, 128, 165
See application file for complete search history.

(56) References Cited

U.S. PATENT DOCUMENTS 923,617 A * 6/1909 Blackmore ..... 81/179
3,641,847 A * 2/1972 Horton ..... 81/179
3,695,125 A * 10/1972 Glass et al. ..... 81/179
3,709,073 A * 1/1973 Kurtz ..... 81/119
4,158,975 A * 6/1979 DeSousa ..... 81/179
7,878,095 B2 * 2/2011 Wu ..... 81/179
8,413,554 B2 * 4/2013 Lee ..... 81/179

* cited by examiner

*Primary Examiner* — Hadi Shakeri

(57) ABSTRACT

A one-way open-end wrench includes two jaws and a swing block. The first jaw includes a flat face, a concave face, and a supporting element extending on the concave face and including two flat ends. The swing block includes two fins extending on an upper face of a platform. Each fin includes a convex face corresponding to the concave face. The fins are connected to the supporting element so that the swing block can swing relative to the supporting element. The lower face of the platform does not extend parallel to the flat face of the first jaw when the first flat end of the supporting element contacts the upper face of the platform. The lower face of the platform extends parallel to the flat face of the first jaw when the second flat end of the supporting element contacts the upper face of the platform.

6 Claims, 10 Drawing Sheets

ONE-WAY OPEN-END WRENCH

BACKGROUND OF INVENTION

1. Field of Invention

The present invention relates to an open-end wrench and, more particularly, to a one-way open-end wrench.

2. Related Prior Art

A conventional open-end wrench includes two jaws extending from a handle. The jaws are engaged with a fastener such as a nut and a head of a screw. The open-end wrench is pivoted to turn the nut or screw for an angle. The jaws are disengaged from the nut or screw. The open-end wrench is returned. This process is repeated for several times so that the nut or screw is tight or slack. The repeating of this process is however troublesome.

As disclosed in U.S. Pat. Nos. 3,695,125, 3,709,073 and 4,158,975, a one-way open-end wrench includes a movable block attached to a first one of two jaws extending from a handle. The movable block and the second jaw are engaged with a nut or screw. The one-way open-end wrench is pivoted in a direction to turn the nut or screw for an angle. The one-way open-end wrench is pivoted in an opposite direction without turning the nut or screw. This process is repeated for several times so that the nut or screw is tight or slack. The first jaw is made with a recess to contain the movable block. The strength of the first jaw is inevitably reduced by the recess. Moreover, it involves a complicated process to make the one-way open-end wrench.

As disclosed in U.S. Pat. No. 7,878,095, a one-way open-end wrench includes two jaws 21 and 22 extending from a handle 10. The jaw 22 is made with a concave arched surface 221 in which a slot 222 is defined. A swing member 23 includes a peripheral protrusion 233 that includes a groove 234.

A spring 26 is placed in the groove 234 before the peripheral protrusion 233 is rotationally placed in the slot 222. A pin 224 is inserted in the groove 234 via apertures 223 defined in the jaw 22. The spring 26 is compressed between a closed end of the groove 234 and the pin 224. Thus, the swing member 23 is returned by the spring 26 placed against the spring 26. With the pin 224, the swing member 23 is retained on the jaw 22 and the strength of the jaw 22 is enhanced. The making of the slot 222 is difficult. Moreover, there is a certain relation between parameters S and H as follows:

$$29\% S<H<58\% S$$

The foregoing relation however does not facilitate the sliding of the swing member 23 on the concave arched surface 221 as expected. Moreover, the spring 26 hinders the sliding of the swing member 23 on the concave arched surface 221. Furthermore, it involves a complicated process to make the one-way open-end wrench.

The present invention is therefore intended to obviate or at least alleviate the problems encountered in prior art.

SUMMARY OF INVENTION

It is an objective of the present invention to provide a one-way open-end wrench with a simple structure.

It is another objective of the present invention to provide a one-way open-end wrench that can easily be made.

It is another objective of the present invention to provide a one-way open-end wrench that can smoothly be operated.

To achieve the foregoing objectives, the one-way open-end wrench includes two jaws and a swing block. The first jaw includes a flat face, a concave face, and a supporting element extending on the concave face and including two flat ends. The swing block includes two fins extending on an upper face of a platform. Each fin includes a convex face corresponding to the concave face. The fins are connected to the supporting element so that the swing block can swing relative to the supporting element. The lower face of the platform does not extend parallel to the flat face of the first jaw when the first flat end of the supporting element contacts the upper face of the platform. The lower face of the platform extends parallel to the flat face of the first jaw when the second flat end of the supporting element contacts the upper face of the platform.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
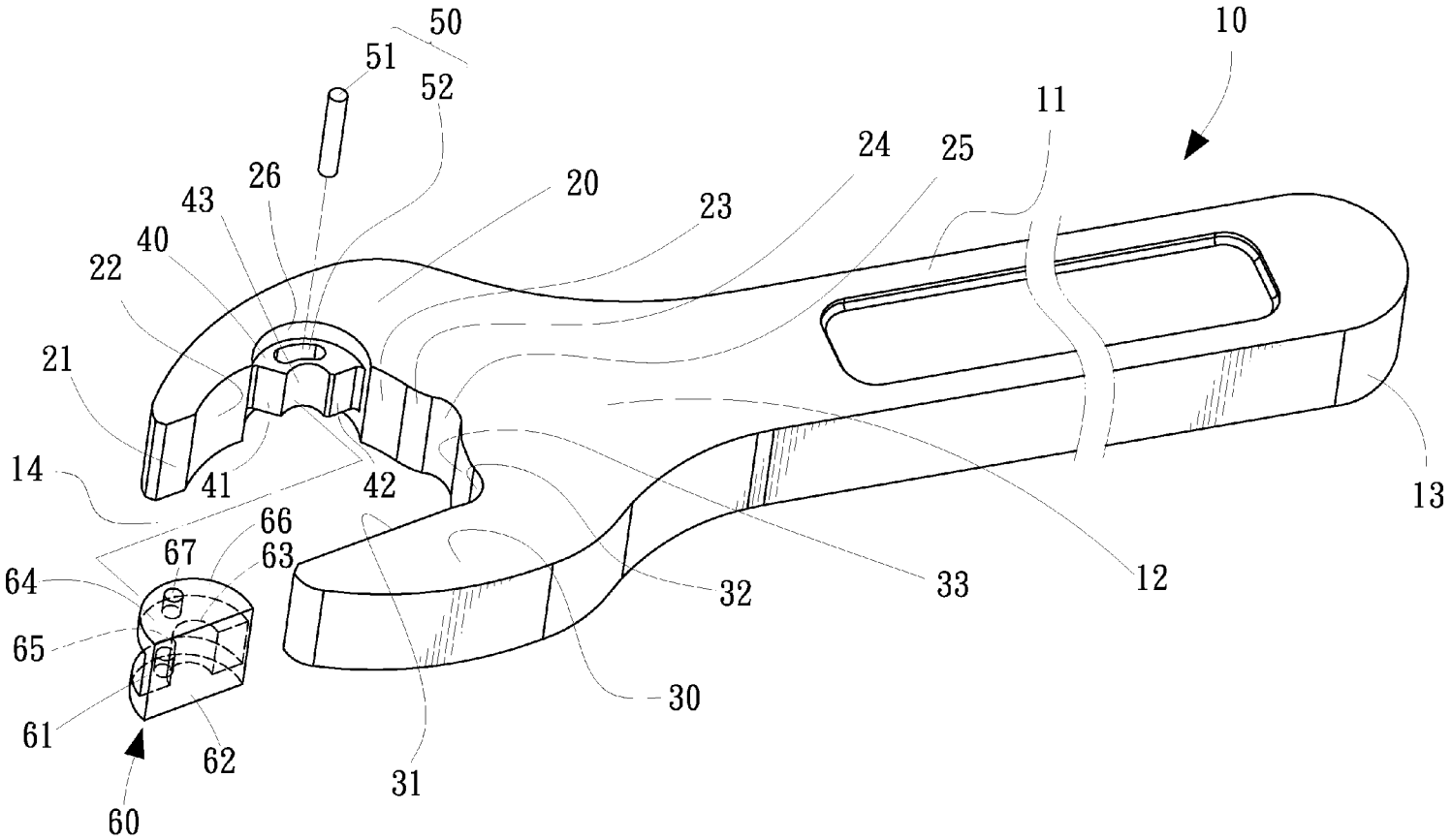
FIG. 1 is an exploded view of a one-way open-end wrench according to the first embodiment of the present invention.

Referring to FIG. 1, there is shown a one-way open-end wrench 10 according to a first embodiment of the present invention. The one-way open-end wrench 10 includes a handle 11, a head 12 formed at an end of the handle 11, a tail 13 formed at an opposite end of the handle 11, and a swing block 60 pivotally connected to the head 12. The head 12 includes two jaws 20 and 30 separated from each other by a gap 14 and a concave face 25 formed between the jaws 20 and 30.

The first jaw 20 includes a flat face 21 formed near the tip, a concave face 22 formed next to the flat face 21, a concave face 26 formed next to the concave face 22, a concave face 23 formed next to the concave face 26, and a convex face 24 formed between the concave faces 26 and 25. The curvature of the concave face 26 is larger than those of the concave faces 22 and 23. The curvature of the concave face 22 may be identical to that of the concave face 23.

There is a supporting element 40 extending on and along a midline of the concave face 26. The thickness of the supporting element 40 is smaller than that of the jaw 20. The supporting element 40 includes a concave face 43 extending between two flat ends 41 and 42.

The second jaw 30 includes a flat face 31 extending from the tip for almost the entire length thereof, a concave face 32 extending next to the flat face 31, and a convex face 33 extending between the concave faces 32 and 25. The flat face 31 extends parallel to the flat face 21.

Figure 2:
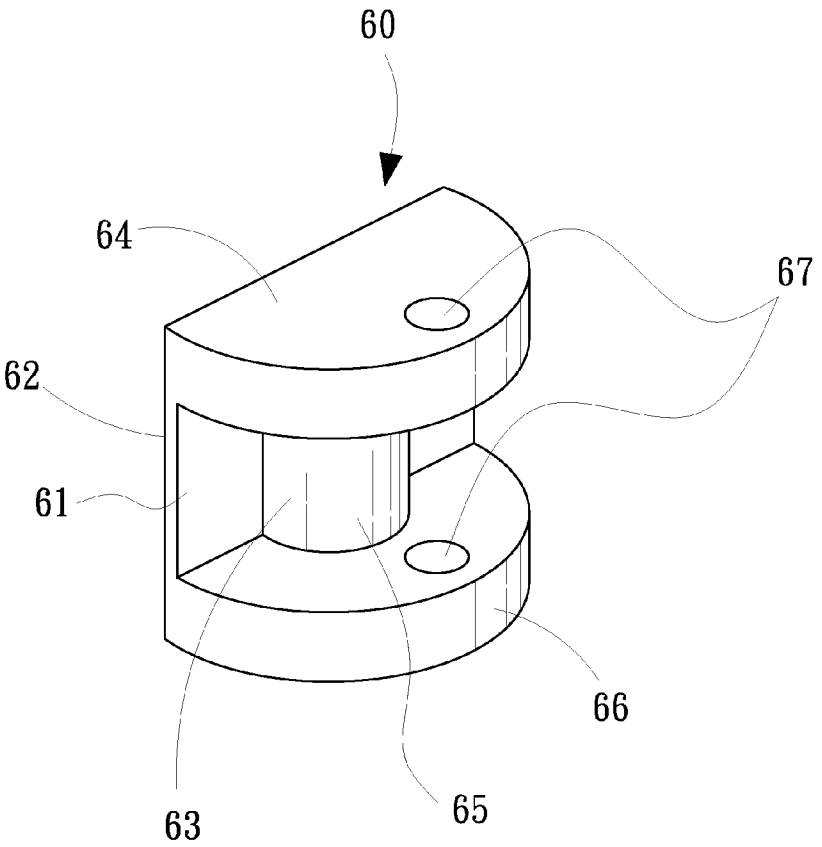
FIG. 2 is a perspective view of a swing block of the one-way open-end wrench shown in FIG. 1.

Referring to FIG. 2, the swing block 60 includes a platform 61 formed with a flat lower face 62 and a flat upper face, a hunch 63 formed on the flat upper face of the platform 61, and two fins 64 formed on the flat upper face of the platform 61. The hunch 63 is formed between the fins 64. The hunch 63 includes a convex face 65 corresponding to the concave face 43. Each fin 64 includes a bore 67 defined therein and a convex face 66 corresponding to the concave face 26. The gap between the fins 64 is marginally larger than the thickness of the supporting element 40.

Figure 3:
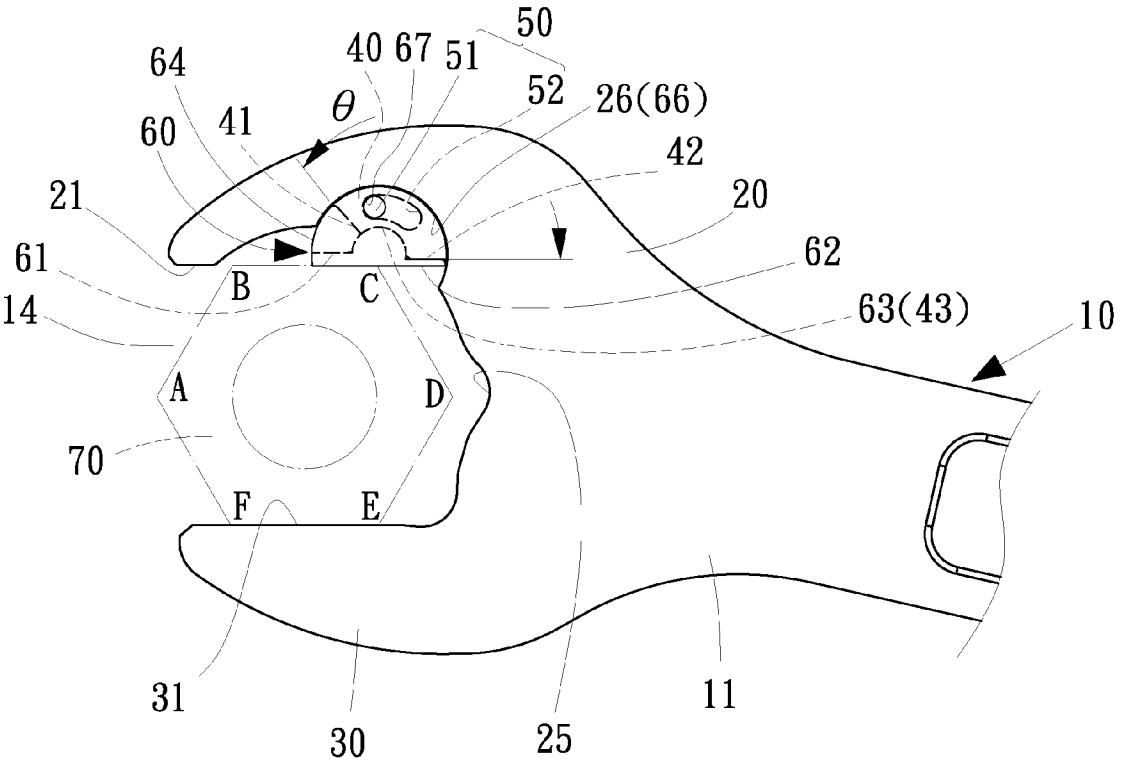
FIG. 3 is a side view of the one-way open-end wrench shown in FIG. 1.

Referring to FIG. 3, in assembly, the supporting element 40 is inserted in the gap between the fins 64. The convex faces 66 are movably placed on the concave face 26 while the convex face 65 may be in contact with or very close to the concave face 43.

There is a connecting device 50 for connecting the swing block 60 to the supporting element 40. The connecting device 50 includes a pin 51 and an arched slot 52 defined in the supporting element 40. The pin 51 includes a middle portion inserted in the arched slot 52 and two ends fit in the bores 67. The diameter of the pin 51 is marginally larger than that of the bores 67 so that the ends of the former are fit in the later. Hence, the wing block 60 is retained on the supporting element 40. The diameter of the pin 51 is marginally smaller than the width of the arched slot 52. Hence, the pin 51 is smoothly movable in and along the arched slot 52, i.e., the swing block 60 can smoothly swing relative to the supporting element 40. Because of the flat upper face of the swing block 60 and a angle θ of 120° to 150° between the flat ends 41 and 42, the swing block 60 can swing for 60° to 30°.

In use, a fastener 70 is placed in the gap 14. The fastener 70 may be a nut or a head of a screw for example. The fastener 70 includes six angles A, B, C, D, E and F. Therefore, the fastener 70 includes six flat faces AB, BC, CD, DE, EF and FA. For example, the face BC of the fastener 70 is in contact with the flat lower face 62 of the swing block 60 while the face EF of the fastener 70 is in contact with the flat face 31 of the jaw 30.

Figure 4:
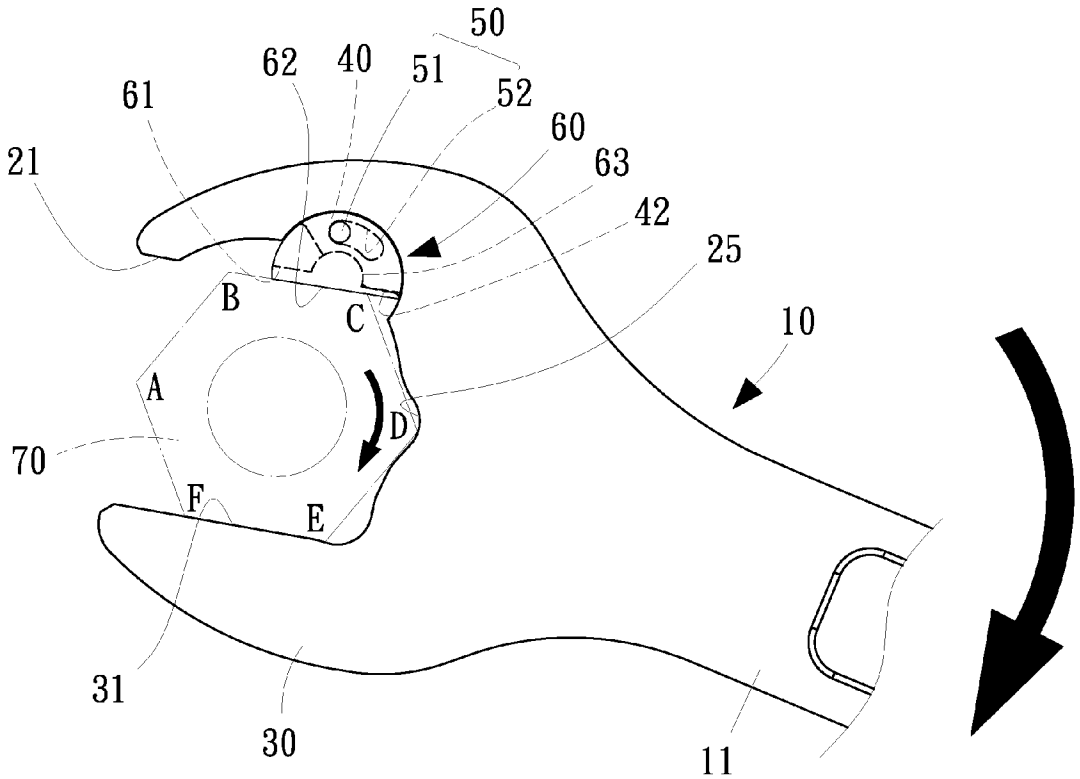
FIG. 4 is a side view of the one-way open-end wrench in another position than shown in FIG. 3.

Referring to FIG. 4, the one-way open-end wrench 10 is in an active stroke in which the handle 11 is pivoted clockwise and so is the head 12 of the one-way open-end wrench 10. The flat end 42 of the supporting element 40 is in contact with the flat upper face of the swing block 60. Hence, the fastener 70 is rotated clockwise by the swing block 60 and the jaw 30. The angle D of the fastener 70 is placed near the concave face 25. In the active stroke, the flat lower face 62 of the swing block 60 is parallel to the flat face 21 of the jaw 20 and the flat face 31 of the jaw 30.

Figure 5:
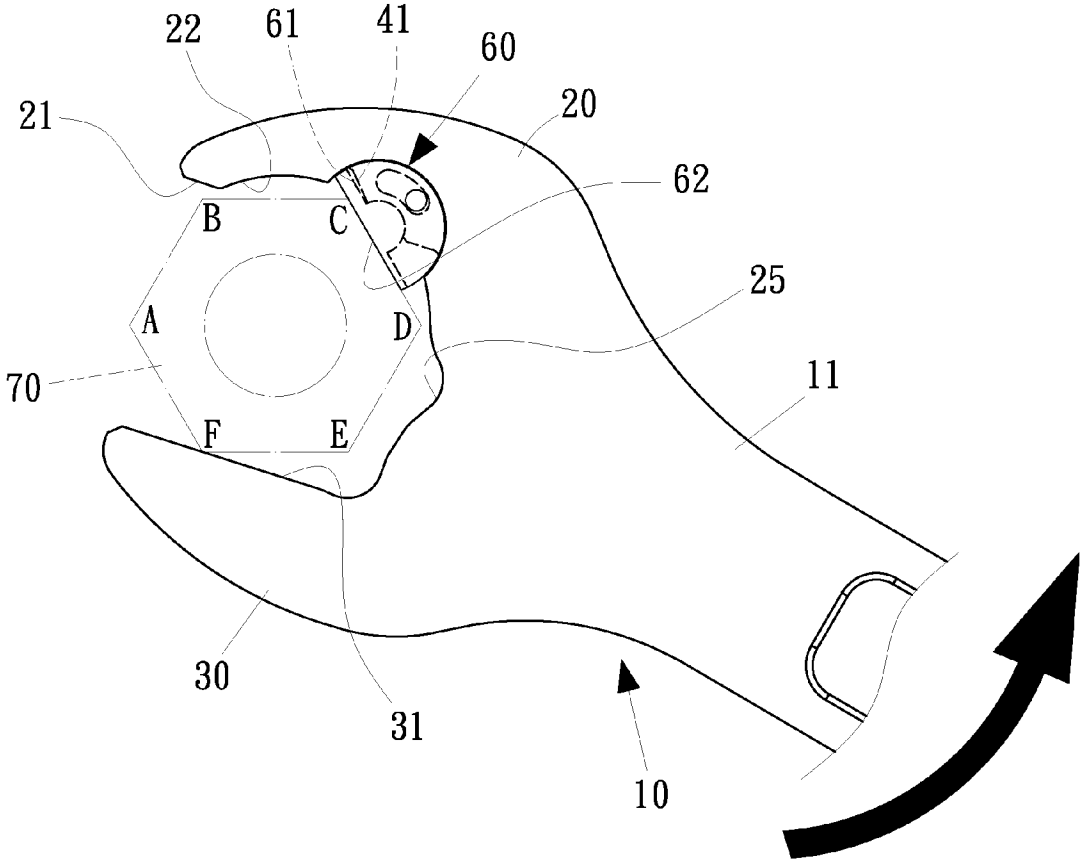
FIG. 5 is a side view of the one-way open-end wrench in another position than shown in FIG. 4.

Referring to FIG. 5, the one-way open-end wrench 10 is in a neutral or idle stroke in which the handle 11 is pivoted counterclockwise and so is the head 12 of the one-way open-end wrench 10. The flat lower face 62 of the swing block 60 is in contact with the face CD of the fastener 70 for example while the flat face 31 of the jaw 30 is in contact with the angle F of the fastener 70.

The flat end 41 of the supporting element 40 is in contact with the flat upper face of the swing block 60. The swing block 60 swings relative to the jaw 20 while the flat lower face 62 of the swing block 60 slides on the angle B of the fastener 70 while the flat face 31 of the jaw 30 is in contact with the angle E of the fastener 70. The angle D of the fastener 70 is moved away from the concave face 25. The concave face 22 of the jaw 20 does not interfere with the angle B. Hence, the head 12 of the one-way open-end wrench 10 is allowed to pivot counterclockwise relative to the fastener 70. In the idle stroke, the flat lower face 62 of the swing block 60 is not parallel to the flat face 21 of the jaw 20 and the flat face 31 of the jaw 30.

Figure 6:
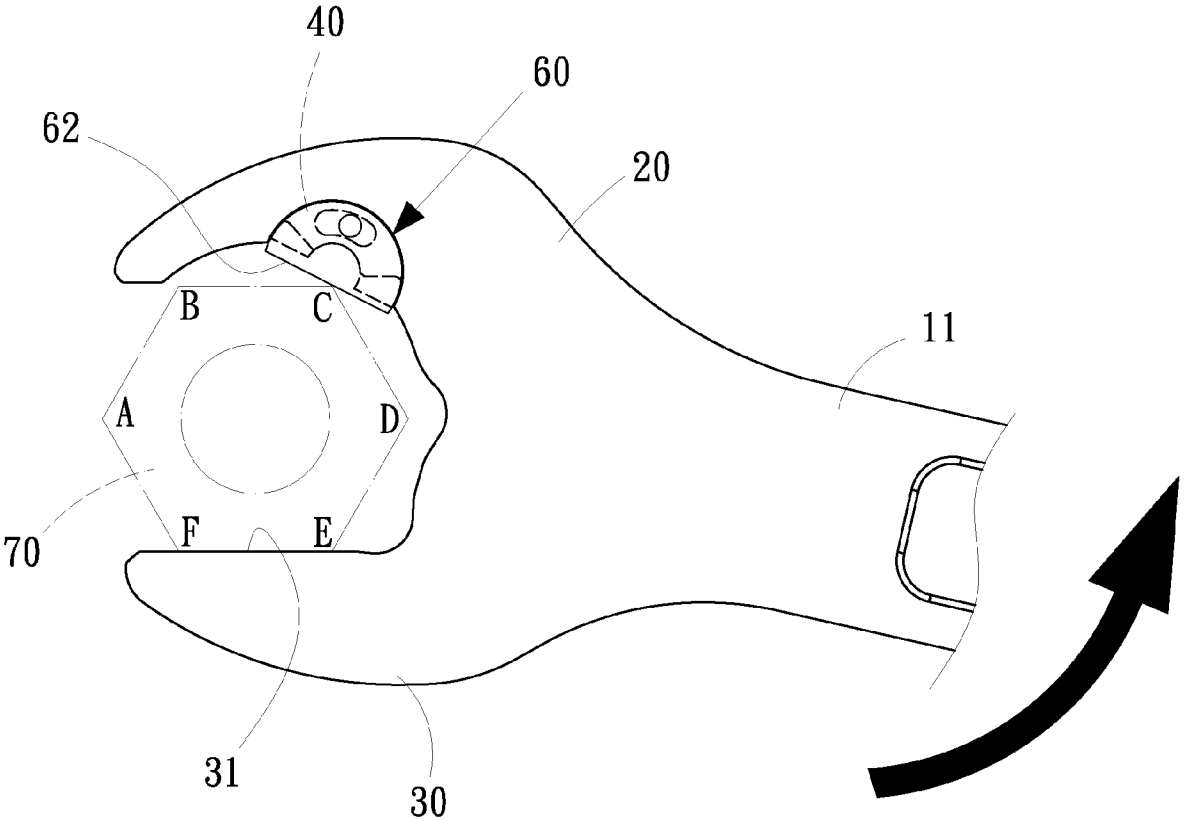
FIG. 6 is a side view of the one-way open-end wrench in another position than shown in FIG. 5.

Referring to FIG. 6, the one-way open-end wrench 10 is in another position in the idle stroke. The flat lower face 62 of the swing block 60 is in contact with the angle B of the fastener 70 while the flat face 31 of the jaw 30 is in contact with the face DE of the fastener 70.

Figure 7:
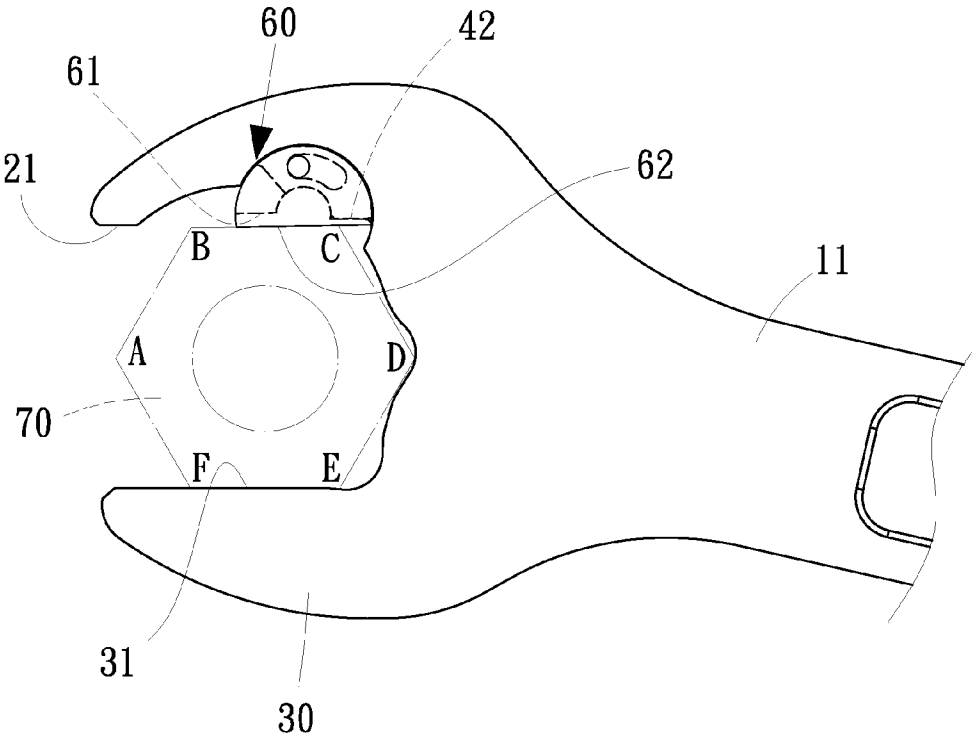
FIG. 7 is a side view of the one-way open-end wrench in another position than shown in FIG. 6.

Referring to FIG. 7, the one-way open-end wrench 10 is at the end of the idle stroke. The flat lower face 62 of the swing block 60 is in contact with the face AB of the fastener 70 while the flat face 31 of the jaw 30 is in contact with the face DE of the fastener 70. The concave face 25 of the head 12 of the one-way open-end wrench 10 is in the vicinity of the angle C of the fastener 70. Now, the one-way open-end wrench 10 is ready for another active stroke.

Figure 8:
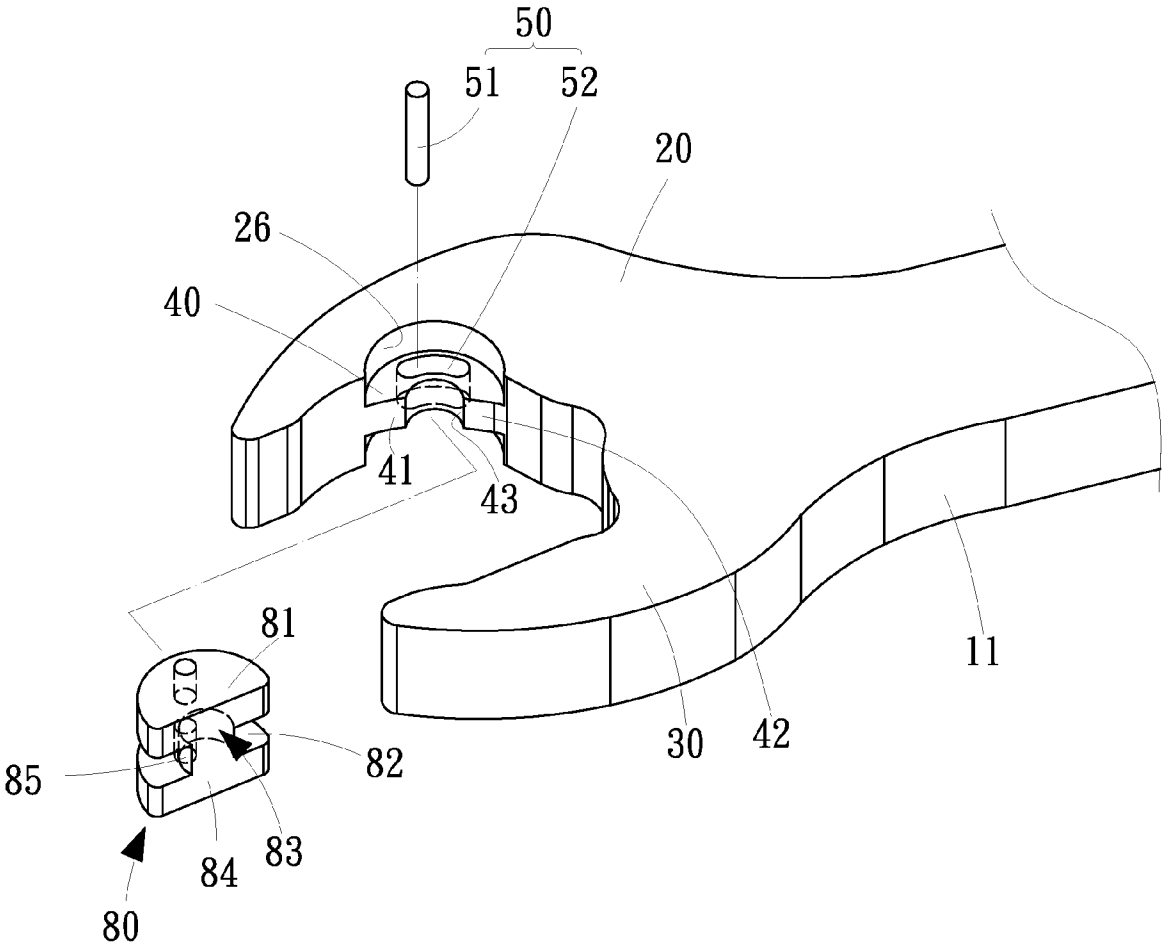
FIG. 8 is an exploded view of a one-way open-end wrench according to the second embodiment of the present invention.

Referring to FIG. 8, there is shown a one-way open-end wrench according to a second embodiment of the present invention. The second embodiment is like the first embodiment except including a swing element 80 instead of the swing block 60. The swing block 80 includes a hunch 83 formed between two fins 81. Each fin 81 includes a convex upper face 82 corresponding to the concave face 26. The hunch 83 includes a convex upper face 85 corresponding to the concave face 43. The lower faces of the fins 81 and a lower face of the hunch 83 together form an H-shaped flat face 84.

Figure 9:
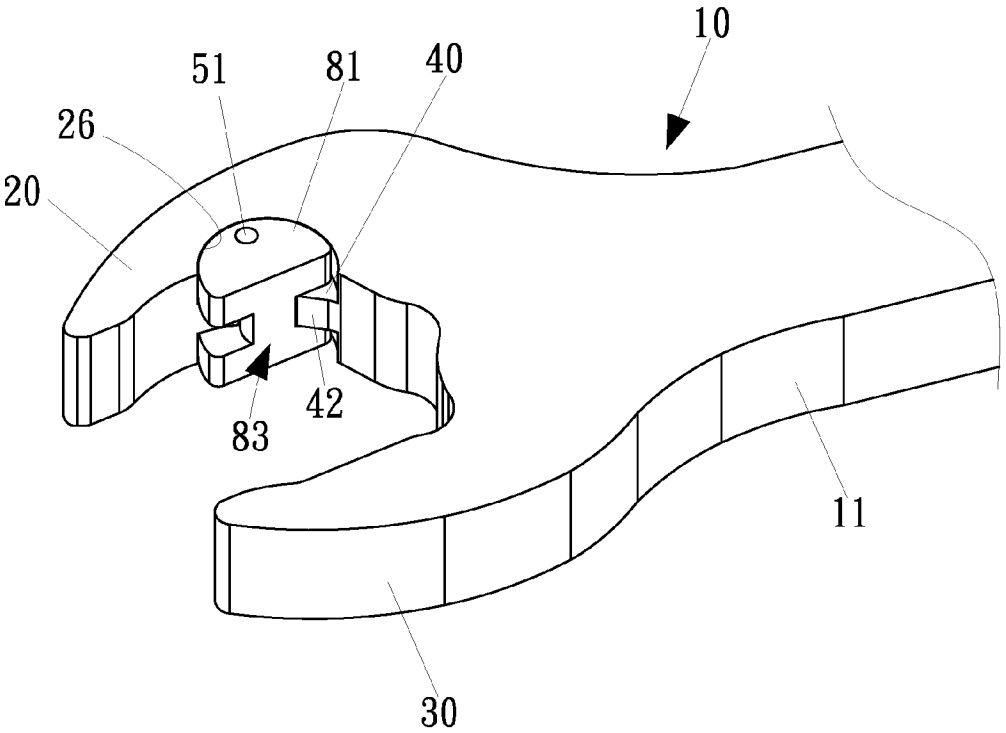
FIG. 9 is a perspective view of the one-way open-end wrench shown in FIG. 8.

Referring to FIG. 9, the middle portion of the pin 51 is inserted in the arched slot 52 while each end of the pin 51 is fit in a bore defined in a respective fin 81. Hence, the wing block 80 is retained on the supporting element 40. The pin 51 is movable in and along the arched slot 52, i.e., the swing block 60 can swing relative to the supporting element 40.

Figure 10:
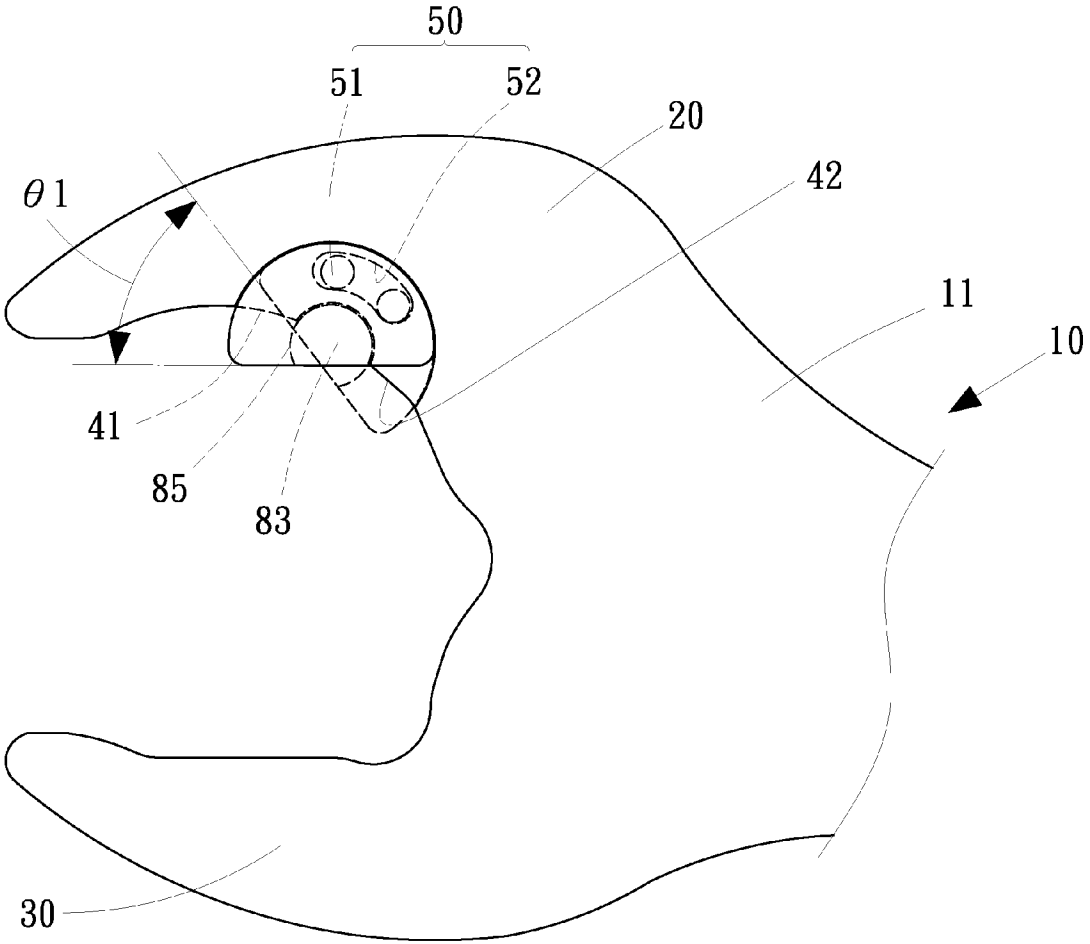
FIG. 10 is a side view of the one-way open-end wrench shown in FIG. 8.

Referring to FIG. 10, when the handle 11 is pivoted clockwise, a first closed end of the arched slot 52 is in contact with the pin 51. The H-shaped flat face 84 is in firm contact with the fastener 70. Hence, the fastener 70 is rotated clockwise by the swing block 60 and the jaw 30.

When the handle 11 is pivoted counterclockwise, a second end of the arched slot 52 is in contact with the pin 51. The swing block 80 swings relative to the jaw 20 while the H-shaped flat face 84 of the swing block 80 slides on the fastener 70. Therefore, the one-way open-end wrench 10 is allowed to pivot counterclockwise relative to the fastener 70.

The one-way open-end wrench of the present invention exhibits several advantages over the prior art. At first, it is structurally simple for not using any spring to bias the swing block. Secondly, it can easily be assembled because it is easy to connect the fins 64 or 81 to the supporting element 40 and there is no need to place any spring in the arched slot 52. Thirdly, it can smoothly be operated because there is not any spring in the arched slot 52 to interfere with the swing of the swing block 60 or 80.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A one-way open-end wrench including first and second jaws and a swing block connected to the first jaw, the one-way open-end wrench being characterized in that:

the first jaw includes a flat face, a concave face, and a supporting element extending on the concave face and including first and second flat ends and a concave face between the first and second flat ends;

the swing block includes:

a platform including a lower face and an upper face;

a hunch extending on the Libber face of the platform and including a convex face in contact with the concave face of the supporting element; and two fins extending on the upper face of the platform and each including an convex face corresponding to the concave face, wherein the fins are connected to the supporting element so that the swing block can swing relative to the supporting element, wherein the lower face of the platform does not extend parallel to the flat face of the first jaw when the first flat end of the supporting element contacts the upper face of the platform, wherein the lower face of the platform extends parallel to the flat face of the first jaw when the second flat end of the supporting element contacts the upper face of the platform.

2. The one-way open-end wrench according to claim 1 characterized in that there is an angle of 120° to 150° between the first and second flat ends of the supporting element.

3. The one-way open-end wrench according to claim 2 characterized in that a connecting device is used to connect the swing block to the supporting element.

4. The one-way open-end wrench according to claim 3 characterized in that the connecting device includes:

an arched slot defined in the supporting element; and a pin including a middle portion movably placed in the arched slot and two ends fit in the fins.

5. A one-way open-end wrench including first and second jaws and a swing block connected to the first jaw, the one-way open-end wrench being characterized in that:

the first jaw includes a flat face, a concave face, and a supporting element extending on the concave face and including first and second flat ends and a concave face between the first and second flat ends;

the swing block includes:

two fins each including an convex face corresponding to the concave face; and a hunch formed between the fins so that a lower face of the hunch and lower faces of the fins together form an H-shaped flat face, wherein the hunch is in contact with the concave face of the supporting element; and a connecting device is used to connect the swing block to the supporting element.

6. The one-way open-end wrench according to claim 5 characterized in that the connecting device includes:

an arched slot defined in the supporting element; and a pin including a middle portion movably placed in the arched slot and two ends fit in the fins.

* * * * *